United States Patent [19]

Kishida et al.

[11] Patent Number: 4,710,994

[45] Date of Patent: Dec. 8, 1987

[54] METHOD OF FORMING A COMPOSITE STRUCTURAL MEMBER

[75] Inventors: Hiroo Kishida; Hirofumi Takenaka, both of Osaka, Japan

[73] Assignee: Harumoto Iron Works Co., Ltd., Osaka, Japan

[21] Appl. No.: 915,900

[22] Filed: Oct. 6, 1986

Related U.S. Application Data

[63] Continuation of Ser. No. 668,821, Nov. 6, 1984, abandoned.

[30] Foreign Application Priority Data

Nov. 7, 1983 [JP] Japan ..... 58-209599
Apr. 9, 1984 [JP] Japan ..... 59-70503

[51] Int. Cl.[4] ..... E01D 1/00

[52] U.S. Cl. ..... 14/1; 14/6; 14/73

[58] Field of Search ..... 14/1, 6, 17, 73; 52/223 R, 174; 404/43, 45, 70

[56] References Cited

U.S. PATENT DOCUMENTS

| | | | |
|---|---|---|---|
| 1,818,254 | 8/1931 | Hewett | 52/223 R |
| 2,590,685 | 3/1952 | Coff | 52/223 R |
| 3,427,772 | 2/1969 | Williams | 52/223 R |
| 4,052,131 | 11/1977 | Lowrigkeit | 404/34 |
| 4,125,580 | 11/1978 | Lippert | 404/47 X |
| 4,282,619 | 8/1981 | Rooney | 14/6 |

OTHER PUBLICATIONS

Composite Steel and Concrete Construction, Knowles, 4-1974, pp. 83-84, TA 664.K57.

Zero Maintenance Expansion Joints & Bearings, Watson, Watson Bowman Associates Inc, 8-1978, pp. 22, 24.

*Primary Examiner*—Stephen J. Novosad
*Assistant Examiner*—Matthew Smith
*Attorney, Agent, or Firm*—Wenderoth, Lind & Ponack

[57] ABSTRACT

A composite structural member is formed by fixedly mounting a prestressed concrete slab having compressive stress acting along pc steel wires buried therein on a beam. The compressive stress is thereafter released from the prestressed concrete slab by loosening a turnbuckle or the like provided in the prestressed concrete slab, so as to produce in the beam a tensile force acting in the same direction as the direction of the compressive stress acting in the prestressed concrete slab and a bending moment.

The slabs, placed in a side by side and end to end configuration, have undulated end surfaces spaced apart on a beam. The ends abut dowels fixed to the main beam. The space defined by the end surfaces with the dowels is filled with mortar to integrally fix the slab to the beam.

3 Claims, 22 Drawing Figures

Fig. 10 (1)
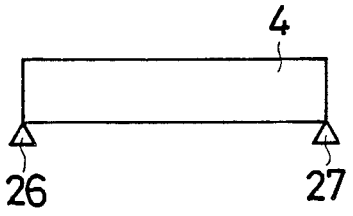
Fig. 10 (2)
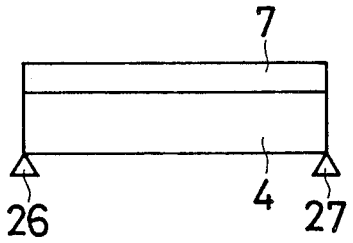
Fig. 10 (3)
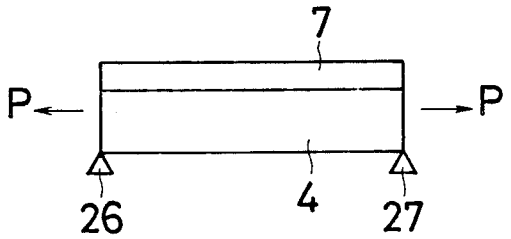
Fig. 11 (1)
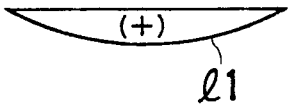
Fig. 11 (2)
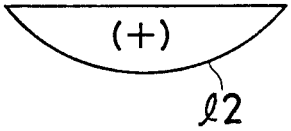
Fig. 11 (3)
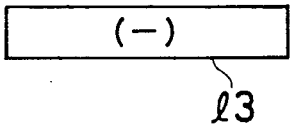
Fig. 11 (4)
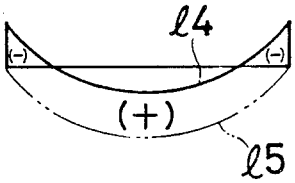

METHOD OF FORMING A COMPOSITE STRUCTURAL MEMBER

This application is a continuation of now abandoned application Ser. No. 668,821, filed Nov. 6, 1984.

BACKGROUND OF THE INVENTION

1. Field of the Invention

This invention generally relates to a method for forming a composite structural member using prestressed concrete members, and more particularly to a method which may be preferably applied to the forming of composite beams by, for example, combining reinforced concrete slabs and beams such as steel beams in a composite beam bridge.

2. Description of the Prior Art

One example of conventional composite structural members widely used includes reinforced concrete floor boards or slabs and beams such as steel beams to form a composite beam bridge. Such composite beams are arranged in such a way that a reinforced concrete slab and a beam are connected by using a connector such as a dowel, whereby both members can resist, in cooperation with each other, the load to be applied thereto. In this conventional method, in order to install reinforced concrete slabs, first the beams are erected, forms are prepared, and then concrete is filled into the forms, thereby necessitating huge manpower requirements and high costs. Besides, in this composite beam bridge, the steel beam area is subjected to a positive bending moment due to vertical loads such as the weight of the beams, dead loads of the slabs, earth covering, balustrade, and pavement, and live loads due to pedestrians and vehicles. As a result, a compressive stress is generated at the upper edge side of the beams, while a tensile stress is generated at the lower edge side. These stresses lead to damage or failure such as cracks in the composite beam bridge. In order to prevent such damage or failure, the cross section of the beams is designed with a proper allowance for such vertical loads. Accordingly, the sectional area of the beam becomes comparatively wide, and therefore the weight of the beam increases, so that the entire size of the composite beam is enlarged. This means an additional cost to the construction of a bridge.

SUMMARY OF THE INVENTION

Therefore, to solve the aforesaid technical problems, it is an object of the invention to provide a method for forming a composite structural member, whereby it is possible to reduce the size and weight of the composite structural member and to decrease the manufacturing cost thereof.

It is another object of the invention to provide a method for forming a composite structural member utilizing a prestressed concrete member which, when employed to construct a bridge, will result in a decrease of manpower and cost required to manufacture the reinforced concrete slabs and a reduction of the size and weight of the beams, thus effecting an economical construction.

A method for forming a composite structural member in accordance with the invention comprises the steps of preparing preliminarily an auxiliary member so arranged that there are compressive stress generating means and compressive stress releasing means, with the compressive stress acting in one direction internally of the auxiliary member by means of the compressive stress generating means, preparing a foundation member, disposing fixedly the auxiliary member on the foundation member in such a way that the compressive stress acts in the axial direction of the foundation member, and thereafter causing the compressive stress releasing means to release the compressive stress from the auxiliary member so as to generate in the foundation member a tensile force acting in the same direction as the direction of the compressive stress and a bending moment.

In a preferred embodiment, the first step comprises burying a plurality of pc steel wires in the auxiliary member in a straight line, forming in the auxiliary member a slot communicating with the outside, disposing in the slot a turnbuckle for connecting the pc steel wires with each other such that pc steel wires pass through the auxiliary member, and applying to the pc steel wires a tension acting away from the turnbuckle so as to produce the compressive stress acting along the axial direction of the pc steel wires inside the auxiliary member, and the last step comprises loosening the turnbuckle so as to release the compressive stress from the auxiliary member.

In another preferred embodiment, the first step comprises burying a sheath tube in the auxiliary member such that the sheath tube passes through the auxiliary member, passing the pc steel wire through the sheath tube, applying to the pc steel wire a tension for urging opposite ends of the wire away from each other, and fixing and maintaining the pc steel wire having the opposite ends thereof thus urged away from each other by means of fixing means, and the last step comprises loosening the fixing means to a desired degree so as to release the compressive stress corresponding to the desired degree from the auxiliary member.

Furthermore, in still another preferred embodiment, the third step comprises placing a plurality of foundation members at specified intervals, disposing across the foundation members a plurality of auxiliary members each having undulated surfaces formed at opposite ends thereof, with the undulated surfaces at the ends of the auxiliary members confronting each other on the foundation members, and filling spaces between the confronting undulated surfaces with a bonding agent, whereby the auxiliary members are fixedly connected to the foundation members.

In yet another preferred embodiment, a concrete member is utilized for the auxiliary member and a steel member is utilized for the foundation member.

Moreover, preferably the concrete member is a precast concrete slab and the steel member is a steel beam.

Consequently, in accordance with the invention, when the composite structural member is formed, it is given a force acting in a dirction reverse to the direction of the compressive force generated by the load and the bending moment to be considered in designing the member and on being relieved of the compressive stress already present inside the composite structure member, thereby achieving a reduction of the size and weight of the member.

BRIEF DESCRIPTION OF THE DRAWINGS

These and other objects, features and advantages of the invention will become more apparent from the following detailed specification and the accompanying drawings, in which:

FIGS. 10(1) through 10(3) are diagrams explaining the intensity of stress acting on the main beam and the concrete slab according to the invention;

FIGS. 11(1) through 11(4) are bending moment diagrams corresponding to FIGS. 10(1) through 10(3);

DETAILED DESCRIPTION OF THE PREFERRED EMBODIMENTS

Figure 1:
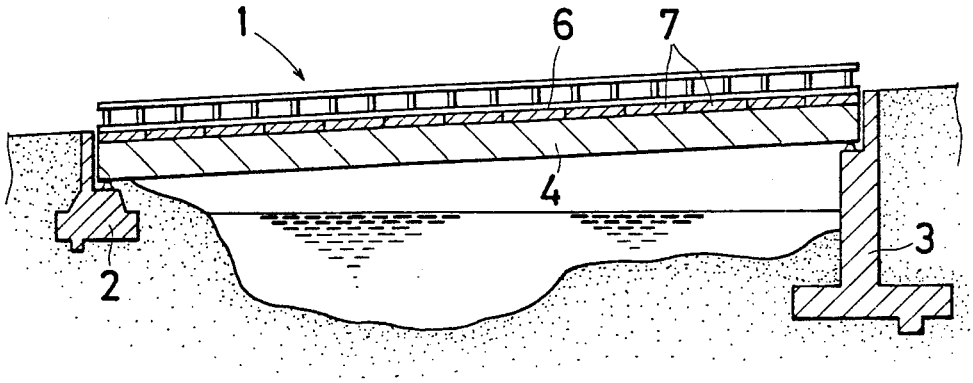
FIG. 1 is a side elevation of an embodiment of a bridge formed in accordance with the invention.
Figure 2:
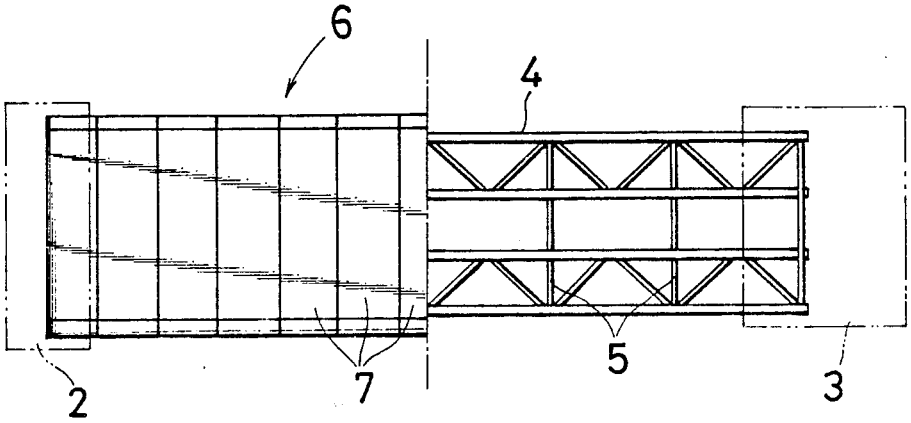
FIG. 2 is a plan view of FIG. 1.

FIG. 1 is a side elevation of one embodiment of a bridge built in accordance with this invention, and FIG. 2 is a plan view of FIG. 1. A bridge 1 is supported by abutments 2 and 3 at opposite ends thereof. The bridge 1 possesses a framework comprising a plurality of main beams 4 (e.g. steel beams) in the forms of I-section beams extending in the axial direction of the bridge 1, and steel members 5 called horizontal beams or opposite inclined structures which are supported by main beams 4. A passage way 6 is placed on the main beams 4. In FIG. 2, the right half of this passage way 6 is omitted for readily understanding the illustration. This passage way 6 is constituted by a plurality of slabs 7 joined with one another and acting as auxiliary members. The concrete slabs 7, as will be mentioned below, have buried or embedded therein a plurality of pc steel wires (high tension steel wires) 8 (see FIG. 3) extending in the widthwise direction and parallel with one another. The concrete slabs 7 are so arranged that the pc steel wires 8 built therein may be parallel to the steel beams 4. Additionally, instead of pc steel wires 8, pc steel bars may be used for the same purpose.

Figure 3:
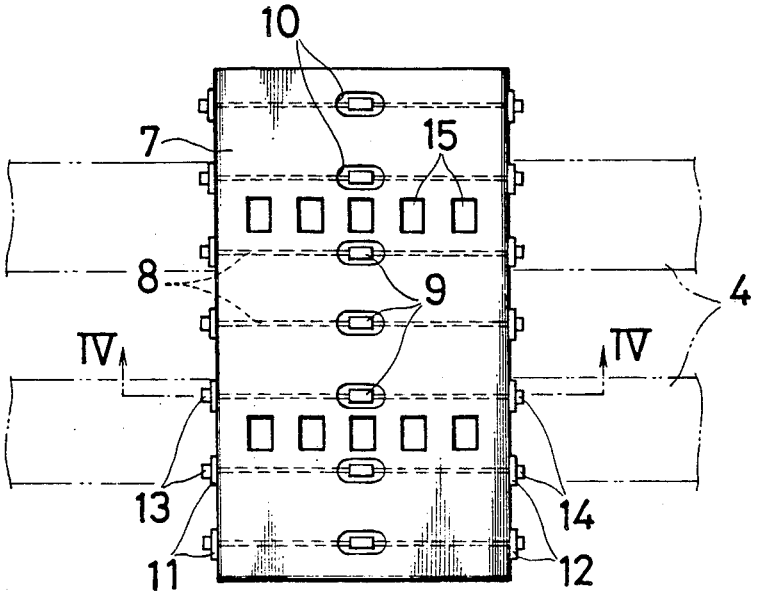
FIG. 3 is a plan view showing a prestressed concrete slab of the invention.
Figure 4:
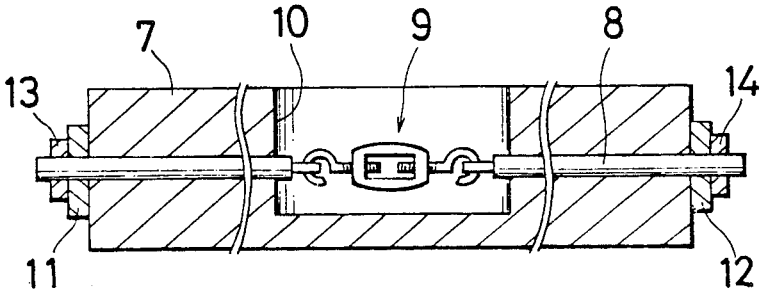
FIG. 4 is a cross section taken along the line IV—IV of FIG. 3.

FIG. 3 is a plan view of prestressed concrete slab 7 in accordance with this invention, and FIG. 4 is a cross section taken along the line IV—IV in FIG. 3. The pc steel wires 8, buried in slabs 7, extend in the widthwise direction (the transverse direction in FIG. 3) and through turnbuckles 9. Recesses or slots 10 are formed in concrete slabs 7, slots 10 being opened upward and enclosing turnbuckles 9. The internal compressive stress of the concrete slabs 7 is released by operating turnbuckles 9 in the slots 10 from the outside. Instead of the turnbuckles, couplers with internal threads extending in the axial direction may be used. The pc steel wires 8 need not necessarily be linked by way of turnbuckles 9 or couplers, and in such a case, the internal compressive force may be released by cutting the pc steel wires 8 in the slots 10. Additionally, slots 15 are provided to be filled with high strength mortar or the like in order to make the main beams 4 and the concrete slabs 7 integral.

Figure 5:
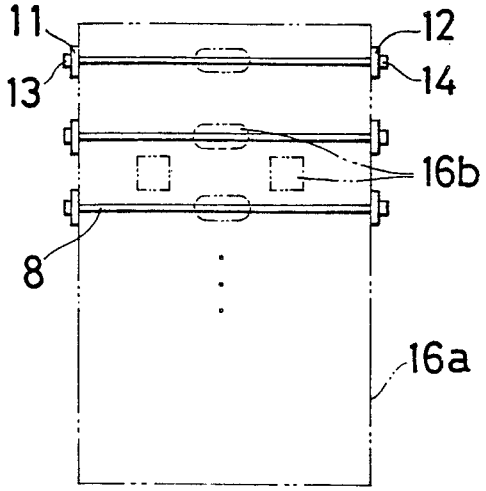
FIG. 5 is a diagram explaining processes for forming the prestressed concrete slab according to the invention.

Such concrete slabs 7 are prefabricated at a shop, etc., by the following procedure. As shown in FIG. 5, a mold or form 16*a* is positioned as indicated as indicated by imaginary lines, and a form 16*b* for slots 10, 15 is positioned if necessary. In form 16*a* are arranged unbonded pc steel wires 8 which do not adhere to concrete, together with necessary reinforcing bars, and concrete is poured therein. After curing for a specified period, a proper tension is applied to the pc steel wires 8 by means of a jack or the like to fix by means of support pressure boards 11 and 12, and fixing members 13 and 14. At this time, a compressive force acts on the concrete with the help of the support pressure boards 11 and 12, and a compressive stress is generated internally of the concrete. Thus, concrete slabs 7 in which a compressive stress is already present can be fabricated.

Figure 6:
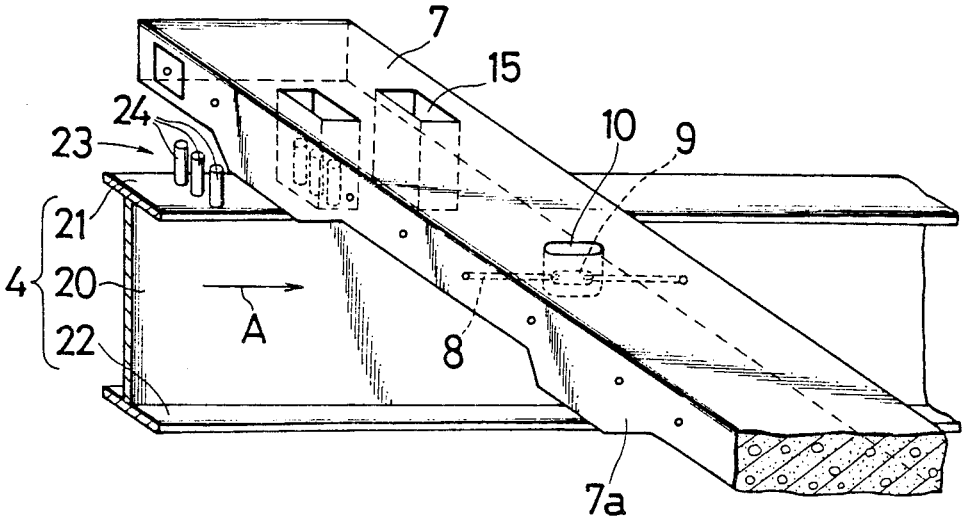
FIG. 6 is a simplified perspective view showing part of the prestressed concrete slab mounted on a main beam according to the invention.
Figure 7:
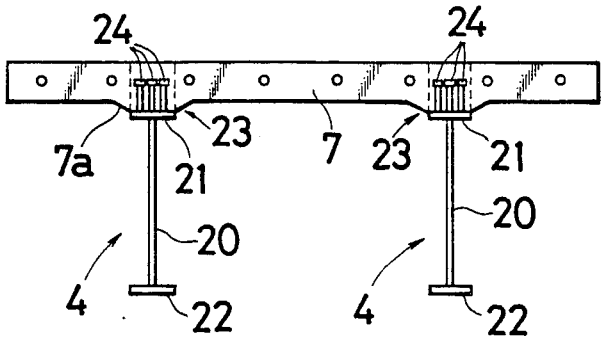
FIG. 7 is a front view seen from the direction of arrow A in FIG. 6.

FIG. 6 is a simplified perspective view showing part of a concrete slab 7 mounted on the main beam 4, and FIG. 7 is a front view seen from the direction of arrow A in FIG. 6. The main beam 4 extending in the horizontal direction comprises a web 20 extending in the vertical direction, and upper flange 21 and lower flange 22 extending in directions perpendicular to the web 20 at opposite ends thereof. An antiskid member 23 for preventing the concrete slab 7 from slipping is attached to the upper surface of the upper flange 21. This antiskid member 23 is in the form of, for example, a plurality of dowels composed of bar-shaped projections 24 welded on the upper surface of the upper flange 21. A plurality of antiskid members 23 are disposed on the upper surface of the upper flange 21 at spaced intervals therealong.

A plurality of concrete slabs 7 are placed side by side on main beams 4 so that the pc steel wires 8 and main beams 4 are parallel to each other. For fixing the main beams 4 and concrete slabs 7 integrally, protrusions 24 of the antiskid members 23 are inserted into the slots 15 preliminarily provided at predetermined positions of a portion 7*a* of slab 7 projecting downwardly therefrom and then the slots 15 are filled with high strength mortar to fix the concrete slabs 7 and the main beams 4 rigidly and integrally.

Then by loosening the turnbuckles 9 or the fixing members 13 or 14, the tension of the pc steel wires 8 is released. As a result, the concrete slabs 7 having been compressed by a prestress (the existing compressive force) tend to stretch in the widthwise direction. However, since the concrete slabs 7 and the main beams 4 are integrally connected, such elongation is restricted, so that negative moments warping the beam upwardly and tensile forces act on the main beams 4. Therefore, the composite beam made in accordance with the invention has exerted thereon a smaller positive bending moment due to this negative bending moment than an ordinary composite beam composed of unprestressed concrete slabs disposed on main beams. Hence, if a positive bending moment due to a load of vehicles and pedestrians and the like is applied, there is a sufficient allowance to the limit of allowable bending stress, so that the sectional area of main beams may be reduced.

Furthermore, since concrete slabs 7 are prefabricated, and passage way 6 is erected in the field from slabs 7, the present method is more economical than the conventional method of forming a passage way by setting up forms in the field and pouring concrete into the forms, because such forms are unnecessary with the invention. Also, it is not necessary to take into consideration the load of such forms, so that the sectional area of the main beams 4 can be reduced accordingly.

Figure 8:
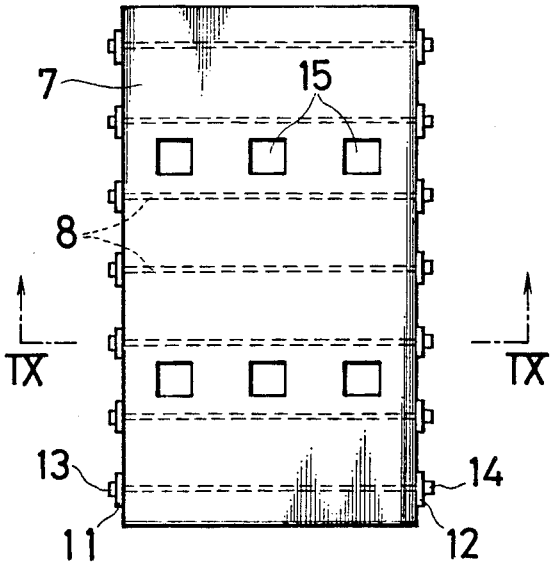
FIG. 8 is a plan view of the prestressed concrete slab according to another embodiment of the invention.
Figure 9:
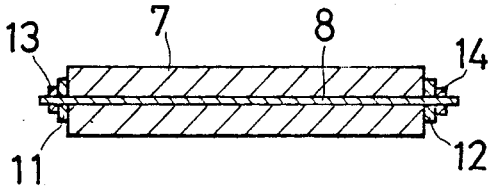
FIG. 9 is a cross section taken along the line IX—IX of FIG. 8.

FIG. 8 is a plan view of a prestressed concrete slab 7 according to another embodiment, and FIG. 9 is a cross section taken along the line IX—IX of FIG. 8. In this embodiment, like numerals are employed for parts corresponding to those of the embodiment shown in FIG. 3. What is noticed in this embodiment is that turnbuckles 9 are not used. Therefore, slots 10 in the embodiment of FIG. 3 are not formed. To release the internal compressive stress from such prestressed concrete slabs 7, the fixing members 13 and 14 of the pc steel wires 8 are loosened by operation of a jack or the like. Additionally, slots 15 are provided for the same purpose as in the embodiment disclosed in FIG. 3.

FIG. 10 illustrates the intensity of stress acting on the beam 4 and concrete slab 7 when the concrete slabs shown in FIG. 3 and FIG. 8 are installed on the main beam 4, while FIG. 11 illustrates bending moments under conditions corresponding to FIG. 10. In FIG. 10, for the convenience of simplified explanation, it is assumed that the main beam 4 is supported by simple fulcrums 26 and 27 at both ends thereof. The state of the beam 4 being supported by fulcrums 26 and 27 is illustrated in diagram (1) of FIG. 10. In this state, the beam 4 is subjected to a positive bending moment l1 expressed by a parabola in diagram (1) of FIG. 11 due to the equally distributed load of its own weight. When concrete slabs 7 are put on the beam 4 and connected thereto, the state is shown in diagram (2) of FIG. 10, with the bending moment l2 shown in diagram (2) of FIG. 11. When the prestress present inside the concrete slabs 7 is released, the tensile force p of the concrete to return to its initial shape acts on the beam 4 as shown in diagram (3) of FIG. 10, and, as a result, a negative bending moment l3 acts on the steel beam 4. To be precise, the negative bending moment l3 due to prestress shown in diagram (3) of FIG. 11 is added to the bending moment in diagram (2) of FIG. 11, so that a bending moment l4 as shown in diagram (4) of FIG. 11 acts on the steel beam 4. In diagram (4) of FIG. 11, the actual bending moment is smaller than the bending moment of an ordinary composite beam, expressed by an imaginary line l5, by the bending moment l3, due to prestressing. Thus, when compared with the ordinary composite beam, the positive bending moment may be decreased in this invention, so that the section of beam 4 may be made smaller.

Figure 12:
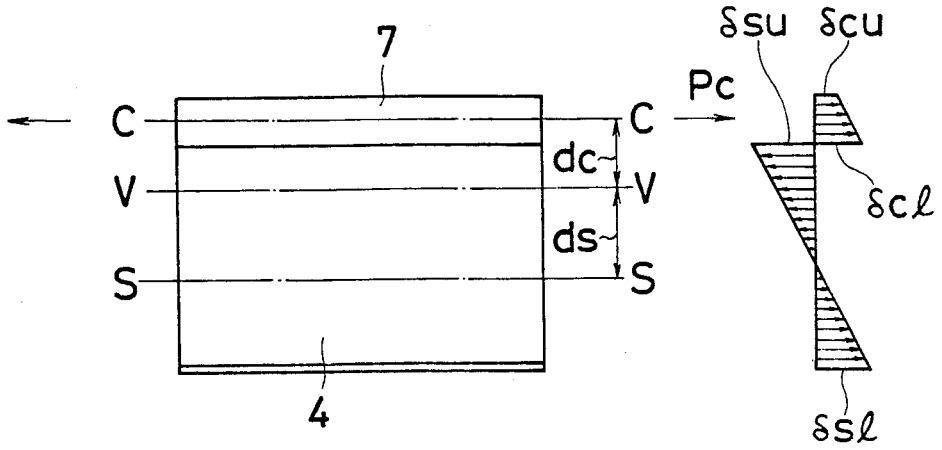
FIG. 12 is a diagram presenting a foundation for analyzing practically the intensity of stress acting on the prestressed concrete slabs and the main beam after releasing of prestress.

FIG. 12 is a diagram presenting a foundation for analyzing practically the intensity of stress acting on the concrete slabs 7 and main beam 4 after releasing of prestress. Sectional forces acting on the composite section, that is, the stress in the axial direction N and the bending moment M are expressed in Eqs. 1 and 2.

$$N=-pc \tag{1}$$

$$M=N\cdot dc=-pc\cdot dc \tag{2}$$

where pc represents prestress, and dc represents the distance between the center of gravity c of the section of concrete slab and the center of gravity v of a composite section.

The edge stresses δsu and δsl of the beam 4 are expressed in Eq. 3.

$$\delta su=\frac{N}{Av}-\frac{M}{Iv}\,yvsu \tag{3}$$

$$\delta sl=\frac{N}{Av}-\frac{M}{Iv}\,yvsl$$

where Av is the sectional area of the composite section, Iv is the second moment of the area of the composite section, yvsu is the distance between the center of gravity of the composite section and an upper flange, and yvsl is the distance between the center of gravity of the composite section and a lower flange.

Putting Eqs. 1 and 2 into Eq. 3, the edge stresses δsu and δsl may be expressed in Eq. 4.

$$\delta su=\frac{-pc}{Av}+\frac{pc\cdot dc}{Iv}\,yvsu \tag{4}$$

$$\delta sl=-\frac{-pc}{Av}+\frac{pc\cdot dc}{Iv}\,yvsl$$

The edge stresses δcu and δcl of concrete slab 7 are expressed in Eqs. 5 and 6, respectively, since the compressive force of prestress pc/concrete slab sectional area Ac is initially present.

$$\delta cu=\frac{pc}{Ac}+\frac{N}{n\cdot Av}-\frac{M}{n\cdot Iv}\,yvcu \tag{5}$$

$$=\frac{pc}{Ac}-\frac{pc}{n\cdot Av}+\frac{pc\cdot dc}{n\cdot Iv}\,yvcu$$

$$\delta cl=\frac{pc}{Ac}+\frac{N}{n\cdot Av}-\frac{M}{n\cdot Iv}\,yvcl \tag{6}$$

$$=\frac{pc}{Ac}-\frac{pc}{n\cdot Av}+\frac{pc\cdot dc}{n\cdot IV}\,yvcl$$

where n is the ratio of elasticity modulus Ec of concrete to elasticity modulus of main beam, that is, $n=Es/Ec$, yvcu is the distance between the center of gravity v of the composite section and the upper surface of concrete slab 7, and yvcl is the distance between the center of gravity v of the composite section and the upper flange.

When erecting a road bridge with a simple live load composite beams by using forms, the loads to be considered before forming a composite structure are generally shown in TABLE 1.

TABLE 1

| | |
|---|---|
| Steel weight | 0.150 t/m$^2$~0.250 t/m$^2$ |
| Floor boards | 0.400 t/m$^2$~0.600 t/m$^2$ |
| Hunches | 0.050 t/m$^2$~0.100 t/m$^2$ |
| Forms | 0.100 t/m$^2$ |

Accordingly, the load to be considered in ordinary composite beams is 0.700 t/m$^2$ to 1.050 t/m$^2$, while the load to be considered in this invention without using forms is 0.600 t/m² to 0.950 t/m². Therefore, the dead load during installation of slabs may be reduced by 14 to 10%. Furthermore, based upon the aforementioned results and Eqs. 4 to 6, the inventors calculated the design relating to the ordinary composite beams and the composite beams according to this invention, and obtained the results partly shown in TABLE 2. In this table, the allowable stress is assumed to be ±2100 kg/cm², and the concrete section, 2736 cm by 230 cm.

TABLE 2

| | Ordinary composite beam | Composite beam by this invention |
|---|---|---|
| Upper flange sectional area (cm²) | 420 × 21 = 90.3 | 380 × 19 = 72.2 |
| Web sectional area | 2000 × 10 = 200 | 2000 × 9 = 180 |
| Lower flange sectional area | 590 × 35 = 206.5 | 610 × 30 = 183 |
| Total surface area | 494.7 | 435.2 |

According to TABLE 2, the weight ratio of the main beam may be expressed as shown in Eq. 7.

$$\frac{388.2 - 341.6}{388.3} \times 100 = 12.0\% \quad (7)$$

That is, in accordance with the invention, the weight of the main beam may be reduced by 12.0% from that of the conventional beam.

Usually, the steel main beam of a composite beam bridge structure is subjected to the positive bending moment due to vertical loads of live loads and dead loads due to the weight of the main beam, the slabs, soil covering, balustrade, pavement, etc., and a compressive stress acts on the upper edge side and a tensile stress is present on the lower edge side. In this method, since a tensile force and a negative bending moment act on the main beam part by releasing stress from the concrete slabs after integrally forming precast prestressed concrete slabs having an internal compressive stress and the main beams, both the compressive stress on the upper edge side and the tensile stress on the lower edge side are reduced as compared with those in the conventional method. Therefore, the method in accordance with the invention enables the composite beam bridge to resist a greater load than that in accordance with the conventional method. That is, when the two are compared in the case of the same vertical load being applied to them, the required sectional area of the main beam in this method is smaller, thereby reducing the size and weight of the main beam. Furthermore, by decreasing the sectional area of the main beam, the beam height can be lowered, so that the load of wind pressure or other factors applied on the side of the bridge may be decreased. Besides, this may be applied in a location where the space beneath the beam is limited, and by diminishing the height of the road structure also is economically advantageous.

In the conventional method, meanwhile, it is necessary to set up forms for installing reinforced concrete slabs, but forms are not necessary in this method because precast slabs which are prefabricated are used, and the manpower and cost for installation of the slabs will be reduced.

Moreover, in the case where the present invention is applied to composite structural members in which a compressive force is present, a tensile force acts on foundation members when a stress is released from precast prestressed concrete members having an internal compressive stress and made integral with the foundation members on which acts the compressive force that is generated by a load to be considered in designing of the members. In consequence the compressive force thus generated by the load is canceled. That is, as in the case of application to a composite beam bridge, by omission of form setup, manpower and cost savings are possible, and the members may be reduced in weight and size, so that economical composite structural members may be obtained.

Figure 13:
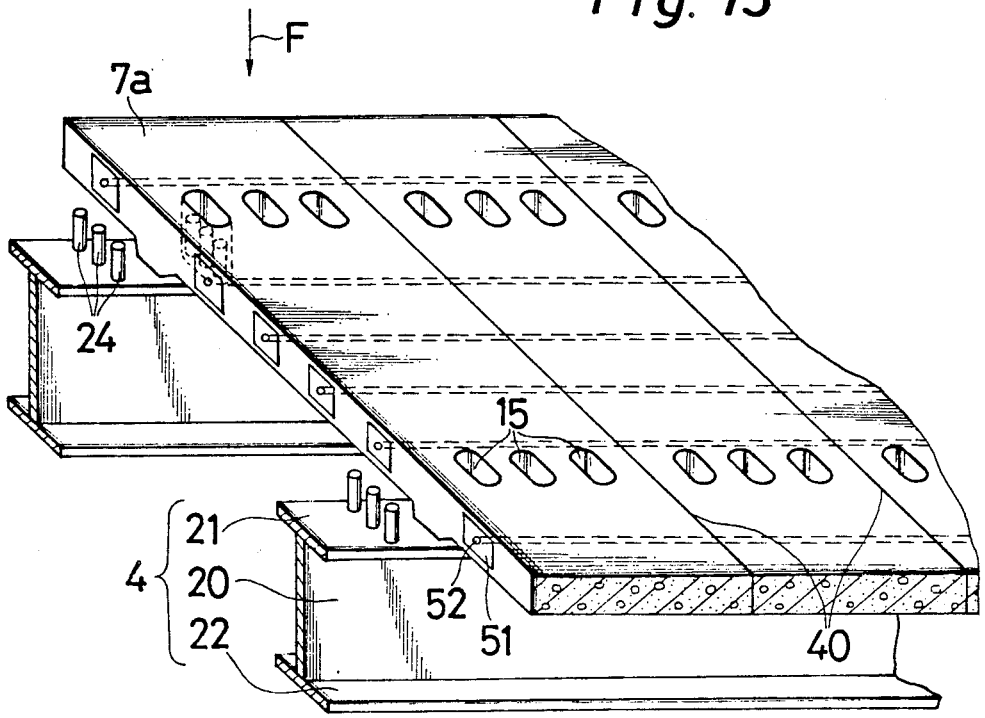
FIG. 13 is a simplified perspective view showing part of the prestressed concrete slabs mounted on the main beam according to another embodiment of the invention.
Figure 14:
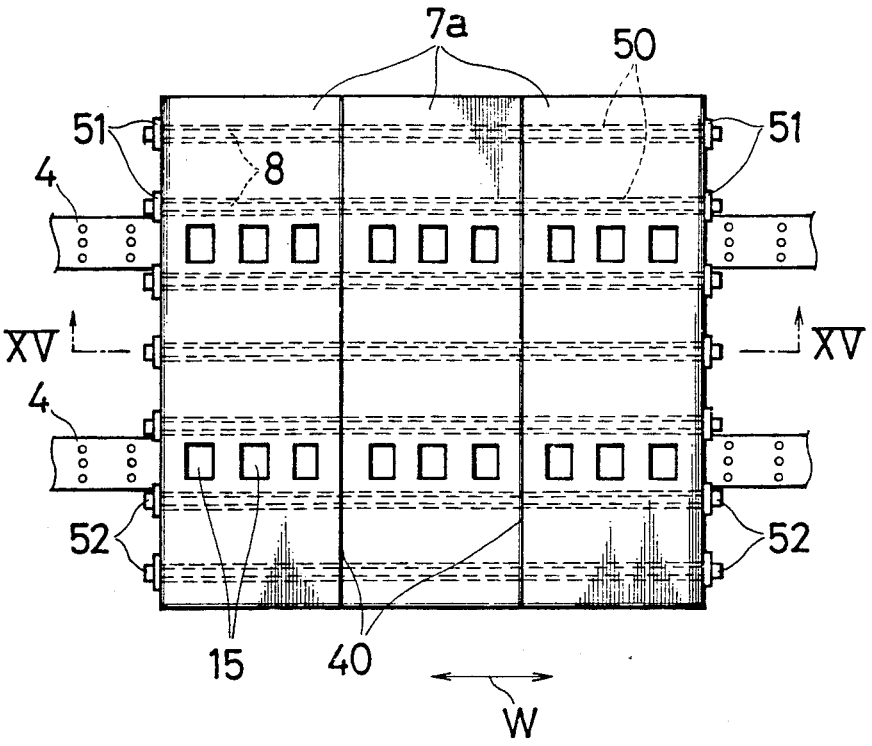
FIG. 14 is a plan view seen from the direction of arrow F in FIG. 13.
Figure 15:
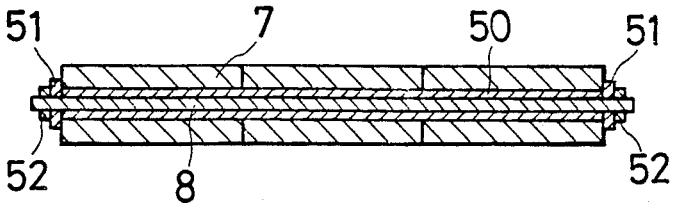
FIG. 15 is a cross section taken along the line XV—XV of FIG. 14.

FIG. 13 is a simplified perspective view showing part of concrete slabs *7a* mounted on main beam 4 in still another embodiment of the invention, FIG. 14 is a plan view seen from the direction of arrow F in FIG. 13, and FIG. 15 is a cross section taken along the line XV—XV of FIG. 14. This embodiment is similar to the preceding ones, and like numerals are given to the corresponding parts. What is of note here is that a plurality of sheath tubes 50 are in advance penetrated through the concrete slab *7a* in the axial direction W of the bridge. The diameter of the sheath tubes 50 is so selected that pc steel wires 8 may loosely pass thereinto.

The process of forming a passage way 6 by mounting the concrete slabs *7a* on the steel beams 4 will be explained below.

In the first step, concrete slabs are provisionally mounted on the beam 4 without gaps therebetween. Then adhesive or cement mortar is applied between seams 40 of the concrete slabs to make the slabs integral with one another. Next, a prestress is introduced into the concrete slabs *7a* in the direction W, and a resultant compressive stress is applied to the concrete slabs. To be precise, pc steel wires 8 are inserted into the sheath tubes 50, and then tension is applied to the pc steel wires 8 by means of a jack or the like and fixed firmly with support plates 51 and fixing members 52. At this time, a compressive force acts on the concrete with the help of the support plates 51, and a compressive stress is generated internally. The fixing members 52 provide means of fixing and securing the compressive stress in the concrete slab, and also have the function on freely adjusting the compressive stress in the concrete slab as mentioned below.

The concrete slab *7a* thus prestressed is formed integrally with the beam 4. Particularly, slots 15 in the concrete slab *7a* are filled with concrete or cement mortar. As a result, the concrete slab *7a* and the beam 4 are mutually fixed and assembled into an integral unit. Thus, the beam and concrete slab *7a* form a composite beam. After thus combining the concrete slab and main beam 4, by relieving the concrete slab of its prestress in the direction W, a tensile force and a bending moment are created on the beam 4. Precisely, by loosening the fixing members 52, the tension of the pc steel wires 8 is released. As a result, the concrete slab *7a* having been compressed by the prestressing (the compressive stress already generated) tends to stretch in the direction W. However, since the concrete slab *7a* is integrally connected with the beam 4, such elongation is arrested, and consequently a negative moment and tensile force warping the beam upwardly act on the steel beam 4. Accordingly, the composite beam formed in accordance with the invention has a smaller positive moment by the amount of the bending moment than the ordinary composite beam composed of unprestressed concrete slabs disposed on the main beam. In consequence, if a positive bending moment due to a live load of vehicles and pedestrians and the like is applied, there is a sufficient allowance to the limit of allowable bending stress, so that the sectional area of the main beam may be reduced. After the relief of the prestress, the sheath tubes 50 are grouted with cement paste or the like.

Furthermore, at the time of relief of the prestress, by loosening the fixing members 52 only to a desired amount, the stress acting on the entire composite structural member can be adjusted as desired.

The concrete slabs *7a* are prefabricated in the above embodiments, but it is evident that the same effect will be obtained by setting up forms in the field and pouring concrete into them as in the conventional field concrete placing method.

Figure 16:
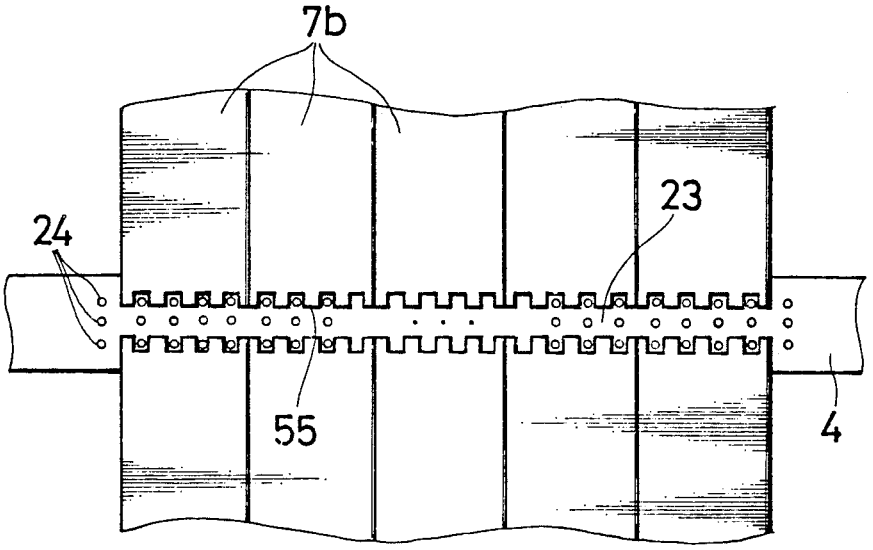
FIG. 16 is a plan view showing the prestressed concrete slabs according to still another embodiment of the invention.
Figure 17:
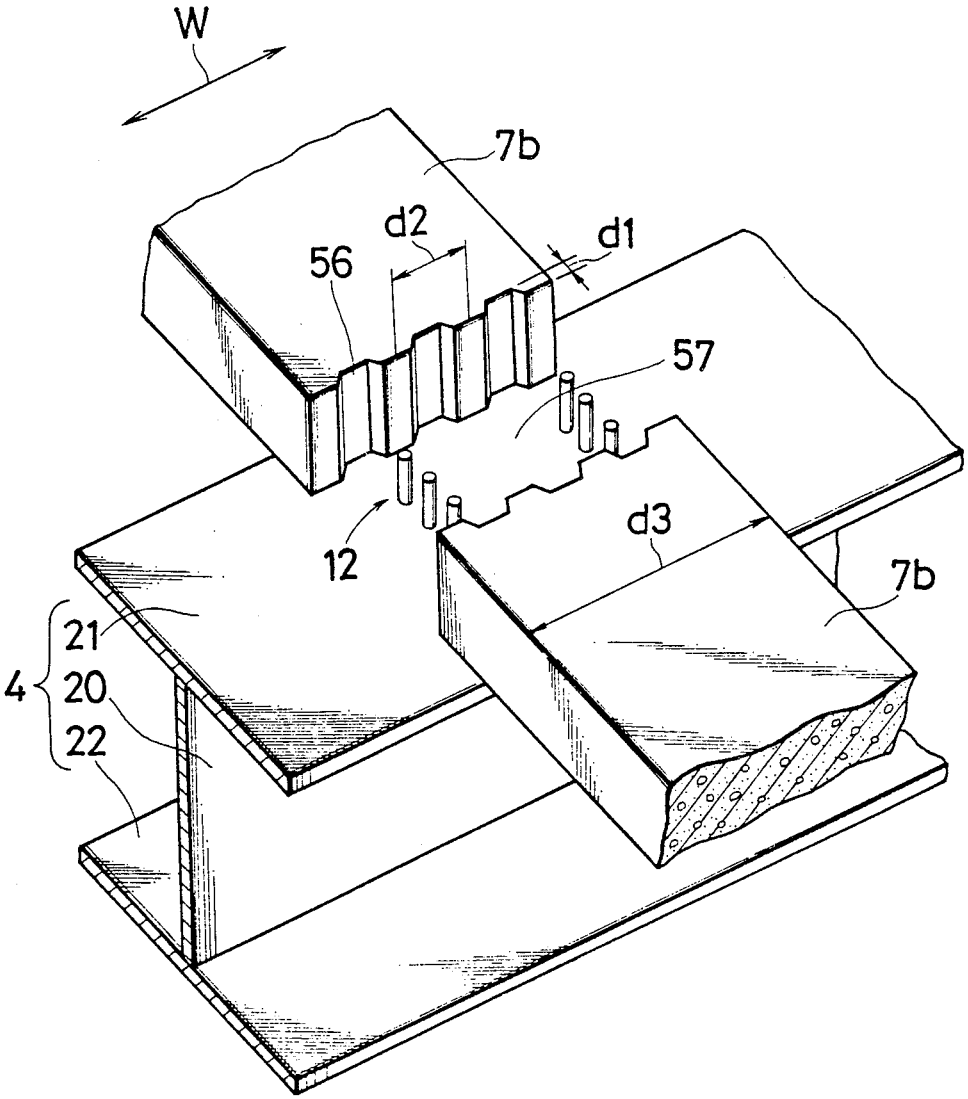
FIG. 17 is an enlarged perspective view showing part of FIG. 16.

FIG. 16 is a plan view of the concrete slab formed by yet another embodiment of the invention, and FIG. 17 is a perspective view magnifying part of FIG. 16. Concrete slabs *7b* have undulated surfaces 55 formed at its opposite ends in the transverse direction. Each of the undulated surfaces 55 forms a plurality of concave end recesses or portions 56 at specified intervals along the bridge axial direction W. If, for example, the width d3 of this concrete slab *7b* is taken as 1.5 m, the depth d1 of the concave portion 56 is 2 cm, and the pitch d2 is 20 cm. The shape of the undulated surface 55 is not limited to that shown in FIG. 17, and as a matter of course, the depth 31 and 32 also are not limited. The concrete slabs *7b* in such shape are disposed, at specified intervals in confronting relation to each other, on the upper flange 21 of the main beam 4. Thereafter, as in the preceding embodiment, prestress is introduced, and the slabs are fixed by the fixing members 52 after the generation of compressive stress. Then, to connect the concrete slabs *7b* and the beam 4, the spaces between the confronting undulated surfaces 55 of the concrete slabs *7b* are filled with concrete or cement mortar or the like. The subsequent prestress relieving method is the same as in the preceding embodiments. Thus, in this embodiment, since undulated surfaces 55 are formed in the concrete slabs *7b*, the slabs *7b* are securely combined with the beam 4, and, when the prestress is released, slipping of the concrete slabs on the beam 4 may be prevented.

In the embodiments set forth herein, in forming of composite structural members, although steel members were employed as the foundation members and concrete members as auxiliary members, the effect is the same when concrete is utilized as the foundation members and steel as the auxiliary members, or as when steel materials are used for both foundation members and auxiliary members, or as when concrete materials are used for both foundation members and auxiliary members. Moreover, the foundation members and auxiliary members may be members composed of compound bodies of concrete and steel.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and the range of equivalency of the claims are therefore intended to be embraced therein.

What is claimed is:

1. A bridge comprising:

a pair of abutments arranged in spaced relationship with each other;

a plurality of main beams placed in parallel with each other on and extending between said pair of abutments;

a plurality of concrete slabs having undulated end surfaces defining concave end recesses, said concrete slabs being disposed to extend transversely across and between said main beams in side-by-side and end-to-end fashion with undulated end surfaces of transversely adjacent said concrete slabs confronting each other;

dowels fixed to said main beams and extending upwardly therefrom into spaces defined between said concave end recesses of said confronting undulated end surfaces;

mortar filling said spaces and thereby integrally fixing said concrete slabs to said main beams; and means for subjecting said concrete slabs to compressive stress acting thereon in the longitudinal direction of said main beams and thereby for imparting to said main beams a tensile force acting in said longitudinal direction thereof and a negative bending moment acting upwardly.

2. A method for constructing a bridge, said method comprising the steps of:

preparing a plurality of concrete slabs each having buried therein a plurality of sheath tubes extending parallel with each other, said preparing comprising forming each said slab with undulated end surfaces at opposite ends thereof;

arranging a pair of abutments in spaced relationship with each other;

placing a plurality of main beams in parallel with each other on and extending between said pair of abutments;

disposing said concrete slabs across said main beams such that said slabs are juxtaposed to extend across said beams and that said sheath tubes in said slabs extend parallel with the longitudinal direction of said beams, said disposing said slabs comprising positioning said slabs on and across said main beams at specified intervals such that said undulated end surfaces of said slabs face one another on said beams;

inserting pc steel wires into said sheath tubes in said slabs;

then producing in said slabs compressive stress acting in a direction parallel with said longitudinal direction of said main beams by applying tension to said pc steel wires by means of stretching means;

fixing said compressive stress to said slabs by means of fixing means;

fixedly securing said concrete slabs on said main beams to thereby integrate said slabs and beams, said securing comprising positioning dowels fixed to said main beams in spaces defined between the thus confronting undulated end surfaces and filling said spaces with mortar, thereby integrally securing said slabs to said beams; and thereafter actuating said fixing means to adjustingly release said compressive stress acting in said slabs thereby producing in said beams a tensile force acting in said longitudinal direction of said beams and a negative bending moment acting upwardly.

3. A method as claimed in claim 2, further comprising forming each said slab to have a dimension of 1.5 m in said longitudinal direction, and forming each said undulated end surface to be defined by concave portions spaced by a pitch of 20 cm and each having a depth of 2 cm.

* * * * *